US007467514B2

(12) United States Patent
Patel

(10) Patent No.: US 7,467,514 B2
(45) Date of Patent: Dec. 23, 2008

(54) SYSTEM AND METHOD FOR CONTROLLING SHAKABILITY OF A WORK TOOL

(75) Inventor: Saujesh Patel, Channahon, IL (US)

(73) Assignee: Caterpillar Inc., Peoria, IL (US)

( * ) Notice: Subject to any disclaimer, the term of this patent is extended or adjusted under 35 U.S.C. 154(b) by 179 days.

(21) Appl. No.: 11/487,654

(22) Filed: Jul. 17, 2006

(65) Prior Publication Data

US 2008/0010981 A1 Jan. 17, 2008

(51) Int. Cl.
*F15B 11/00* (2006.01)
*E02F 3/43* (2006.01)

(52) U.S. Cl. ..... 60/381; 60/452

(58) Field of Classification Search ..... 60/381, 60/445, 452, 368, 443, 465; 700/75
See application file for complete search history.

(56) References Cited

U.S. PATENT DOCUMENTS 5,235,809 A 8/1993 Farrell
6,029,445 A * 2/2000 Lech ..... 60/453
6,053,629 A * 4/2000 Nakashima ..... 91/232
6,725,105 B2 4/2004 Francis et al.
6,757,992 B1 * 7/2004 Berger et al. ..... 701/50
6,763,661 B2 * 7/2004 Tabor et al. ..... 60/327
7,117,952 B2 * 10/2006 Bares et al. ..... 37/238
2006/0218913 A1 * 10/2006 Ivantysynova et al. ..... 60/464

FOREIGN PATENT DOCUMENTS

WO WO 2005100701 A1 * 10/2005

* cited by examiner

*Primary Examiner*—Thomas E Lazo

(57) ABSTRACT

A system and method for controlling shakability of a work tool. A series of input commands from a control unit to the hydraulic pump cause the hydraulic pump to cycle between a first displacement (maximum) at a first rate (maximum) and a second displacement (zero) at a second rate (less than maximum), within a predetermined frequency. Ultimately, the hydraulic pump remains in a partially upstroked position at the beginning of every cycle. Accordingly, within a small fraction of time after upstroking, the pump is capable of providing full flow to the actuators, resulting in much faster response and movement of the actuators, and therefore improved shakability of the work implement.

18 Claims, 2 Drawing Sheets

SYSTEM AND METHOD FOR CONTROLLING SHAKABILITY OF A WORK TOOL

TECHNICAL FIELD

This invention relates generally to a system and method for controlling a work tool and, more particularly, to a system and method for controlling shakability of a work tool.

BACKGROUND

During operation of work machines, it is sometimes desirable to move a work tool in a shaking manner to accomplish some purpose. For example, an operator of an earthworking machine having a work tool such as a bucket may desire to cause the bucket to move in a shaking manner to shake material out of the bucket that does not readily fall out.

In the past, the standard method for shaking a work tool has been for an operator to rapidly move the work tool control, such as a joystick or lever, back and forth until the task was completed. This method is a function of rapid motion by the operator that, over time, can become tedious and tiring.

With the advent of electro-hydraulics, it has become possible to automate control of work tools in many ways that required manual control in the past. Computer-based controllers can be programmed to operate electro-hydraulic valves and solenoids with great precision, thus alleviating many of the difficult, tedious, tiring, or time-consuming tasks that operators previously had to perform.

U.S. Pat. No. 5,235,809, entitled "Hydraulic Circuit for Shaking a Bucket of a Vehicle," provides a system and method for shaking a bucket. The system includes a load-sensing variable displacement pump and a hydraulic circuit. A manual control means allows the operator to place the system in an active mode or an inactive mode. When in active mode, the hydraulic circuit forces the load sensing variable displacement pump to maximum displacement to provide standby pressure and flow to a directional valve. Rapid movement of the directional valve operates an actuator in a back and forth movement to shake the debris.

The '809 patent may provide adequate bucket shakability, however, the additional hydraulic circuitry is complex and increases the cost of the equipment. Additionally, the manual control means is inefficient as it requires the operator to manually change the system to shake the bucket.

The present disclosure is directed to overcoming some or all of the shortcomings in the prior art.

SUMMARY OF THE INVENTION

In one aspect of the present invention, a hydraulic system for shaking an implement is provided. The hydraulic system includes at least one actuator connected to the implement, a hydraulic pump for providing fluid to the actuator, and a control module coupled to the hydraulic pump. The control module receives a signal indicative of a desire to shake the implement and cyclically commands the hydraulic pump to upstroke at a first rate and to destroke at a second rate.

In one aspect of the present invention, a hydraulic system for shaking an implement is provided. The hydraulic system includes at least one actuator connected to the implement, a hydraulic pump for providing fluid to the actuator, and a control module coupled to the hydraulic pump. The control module receives a signal indicative of a desire to shake the implement and cyclically commands the hydraulic pump to upstroke at a first and to destroke at a second rate.

In yet another embodiment, a method of shaking an implement is provided. The method includes the steps of receiving a signal indicative of a desire to shake the implement and upstroking a hydraulic pump at a first rate and destroking the hydraulic pump at a second rate. The upstroking and destroking cyclically occurs at a predetermined frequency such that the hydraulic pump is commanded to upstroke before the hydraulic pump fully destrokes.

BRIEF DESCRIPTION OF THE DRAWINGS

The accompanying drawings, which are incorporated in and constitute a part of this specification, illustrate exemplary embodiments or features of the invention and, together with the description, serve to explain the principles of the invention. In the drawings.

DETAILED DESCRIPTION

Reference will now be made in detail to embodiments or features of the invention. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
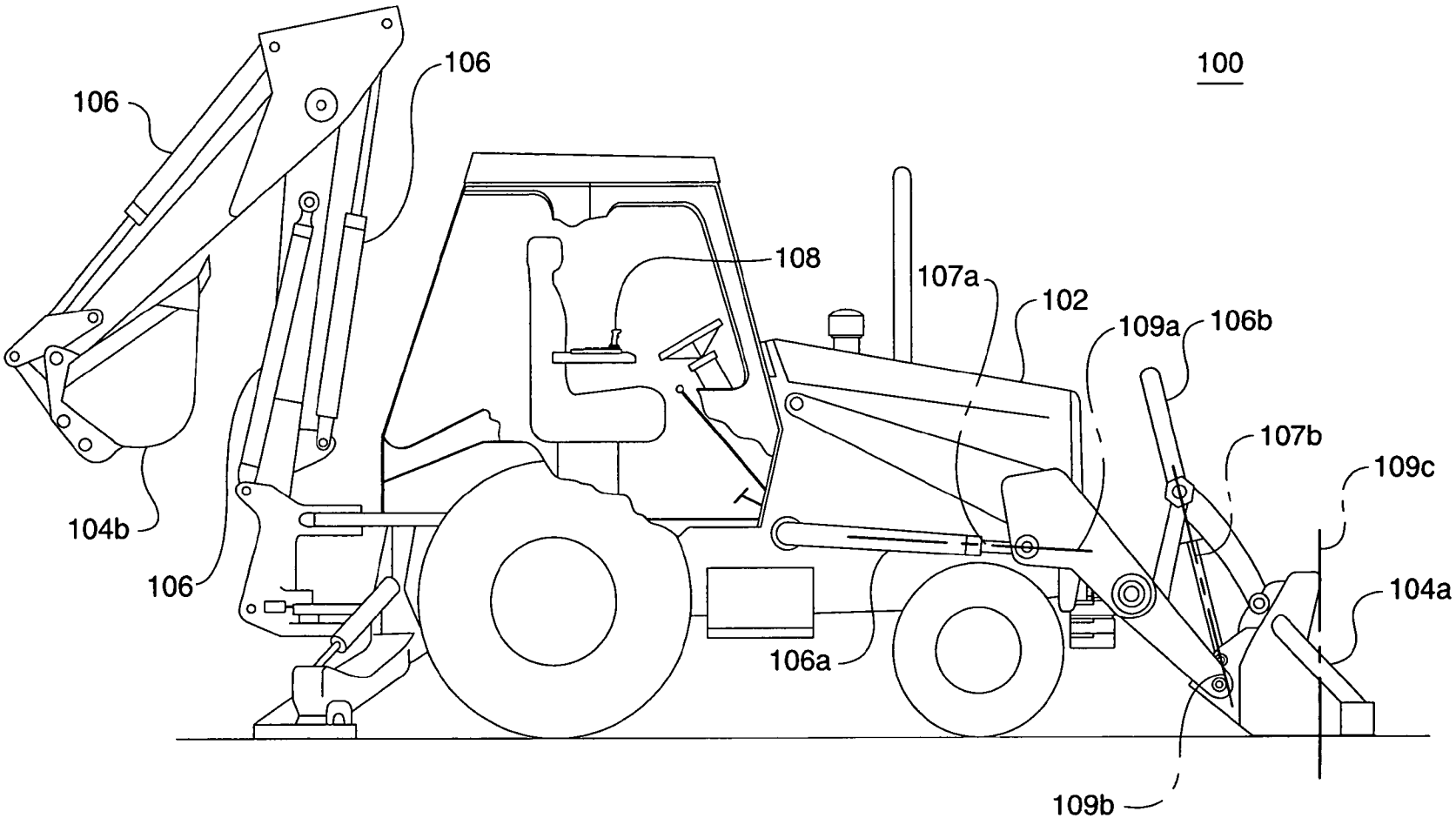
FIG. 1 illustrates a side view of a machine for use with one embodiment of the present invention.

FIG. 1 illustrates a work machine 102. The work machine 102 is shown as an earthworking machine, and in particular, a backhoe loader, however, other types of earthworking machines may apply, such as excavators, wheel loaders, skid steer loaders, front shovels, and track loaders. Furthermore, the work machine 102 may be of a type other than an earthworking machine. For example, the work machine 102 may be a machine used for construction, material transfer, manufacturing, and agriculture.

The work machine 102 includes a work tool 104 for performing a work function of some type according to a desired movement indicated through a joystick 108, or other device, such as a lever. Work tools 104*a*, 104*b* are depicted as buckets. More specifically, work tool 104*a* embodied as a loader bucket is shown at the front of the work machine 102, and another work tool 104*b* embodied as a backhoe bucket is shown at the rear of the work machine 102. It is noted that, although both illustrated work tools 104*a*, 104*b* are shown as buckets, other types of work tools may apply. Examples of other work tools include, but are not limited to, augers, blades, cutting tools, trenchers, and the like.

The work machine 102 includes one or more hydraulic actuators 106, operably coupled to the work tool 104. The work machine 102 includes a first hydraulic cylinder 106*a* to control elevation of the work tool 104*a*, and a second hydraulic cylinder 106*b* to control tilt angle of the work tool 104*a*. Each hydraulic cylinder 106*a*, 106*b* includes an actuation member 107*a*, 107*b* operable to move along an axis 109*a*, 109*b* to change the position of the work tool 104*a*. For example, actuation member 107*a* of hydraulic cylinder 106*a* operates to move along axis 109*a* to control elevation of the work tool 104*a*, while actuation member 107*b* of hydraulic cylinder 106*b* operates to move along axis 109*b* to control the tilt angle of the work tool 104*a*. Selective operation of hydraulic cylinders 106*a* and 106*b* operates to cause dual axis movement of the work tool 104*a*. Additional hydraulic cylinders 106 may also be used to increase degrees of rotation and movement of the work tool 104*a*.

Figure 2:
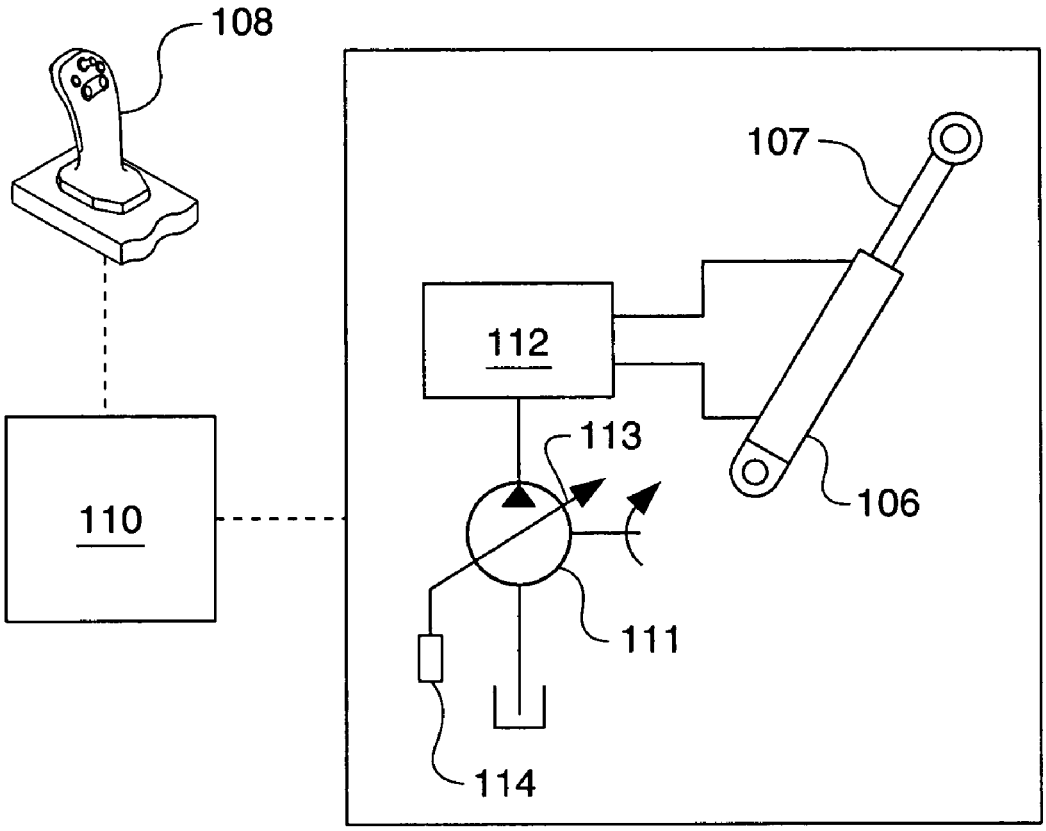
FIG. 2 illustrates a schematic hydraulic circuit according to an embodiment of the present invention.

FIG. 2 illustrates a schematic hydraulic circuit according to one embodiment of the present invention. The hydraulic circuit includes a control unit 110, a hydraulic pump 111, a valve assembly 112, and a hydraulic cylinder 106. The control unit electrically couples the hydraulic pump 111 and the valve 112, while the hydraulic pump 111 provides hydraulic fluid to the valve 112 and the hydraulic cylinder 106 to move the work tool 104 (See FIG. 1). The hydraulic pump 111 may be, for example, a variable displacement pump having a movable swash plate 113. Typically, an actuator 114 controls the position of the swash plate 113. The actuator 114 controllably receives hydraulic fluid from the hydraulic pump 111 to control the position of the swash plate 113. It is noted that the actuator 114 may also be embodied as an electric actuator, or mechanical actuator. Sensors (not shown) may be provided at any location on the machine 102, hydraulic pump 111, hydraulic fluid lines, or hydraulic actuators 106 to provide information, such as pressure, to the control unit 110. Accordingly, the hydraulic pump 111 may be adapted to provide a constant flow or constant pressure, or adapted to switch between the two.

INDUSTRIAL APPLICABILITY

The joystick 108 produces a signal indicative of a desire to shake the work tool 104. An operator may create the signal by cyclically moving the joystick 108 in a front-to-back movement (forward/backward movement), or side-to-side movement, or the like, by pressing a button on the joystick 108, or both.

The control unit 110 receives the signal and commands the actuator 114 to change the displacement of the hydraulic pump 111. It should be appreciated that termination of an indication of the desire to shake the work tool may be determined as an operator stops rapid cyclical movement of the joystick 108, or releases the respective button which delivered the initial signal. Alternatively, the signal indicative of a desire to shake the work tool may be initiated and continued for a predetermined period of time (e.g., 30 seconds) upon activation of the respective button or movement of the joystick.

As an example, the work tool 104*a* may be filled with dirt and held stationary over a dirt pile. When the control unit 110 receives the signal indicative of a desire to shake the work tool, the control unit 110 commands the swash plate to cycle between maximum and zero displacement directly through the control unit 110 or through the hydraulic valve 112. When maximum displacement is reached, the swash plate 113 begins moving to zero displacement. However, before the swash plate reaches zero displacement, the control unit 110 commands the swash plate 113 back to maximum displacement.

In another embodiment, the destroking of the swash plate occurs at a slower rate than the upstroking. As a result, a series of input commands from the control unit 110 to the hydraulic pump 111 cause the hydraulic pump 111 to cycle between a first displacement (maximum) at a first rate (maximum) and a second displacement (zero) at a second rate (less than maximum), within a predetermined frequency. Ultimately, the hydraulic pump 111 remains in a partially upstroked position at the beginning of every cycle. Accordingly, within a small fraction of time after upstroking, the pump is capable of providing full flow to the actuators 106, resulting in much faster movement of the actuators 106, and therefore improved shakability of the work implement. The slower rate of the destroking may be controlled by the frequency or amplitude of the signal from the control unit 110. Similarly, the slower rate of the destroking may also be controlled by decreasing the flow of fluid to the actuator 114 that controls movement of the swash plate. Accordingly, the size of the orifices, or the position of the valves, that control flow to the actuator 114 may be variable, i.e., increased or decreased, to change the amount of fluid sent to the actuator 114.

From the foregoing it will be appreciated that, although specific embodiments of the invention have been described herein for purposes of illustration, various modifications may be made without deviating from the spirit or scope of the invention. Other embodiments of the invention will be apparent to those skilled in the art from consideration of the specification and figures and practice of the invention disclosed herein. It is intended that the specification and disclosed examples be considered as exemplary only, with a true scope and spirit of the invention being indicated by the following claims and their equivalents. Accordingly, the invention is not limited except as by the appended claims.

What is claimed is:

1. A hydraulic system for shaking an implement, comprising:

at least one actuator connected to the implement;

a hydraulic pump adapted to provide fluid to the actuator;

a control module coupled to the hydraulic pump, and adapted to receive a signal indicative of a desire to shake the implement, wherein, upon receiving the signal, the control module cyclically commands the hydraulic pump to upstroke at a first rate and to destroke at a second rate.

2. The hydraulic system according to claim 1, wherein the hydraulic pump is a load-sensing variable displacement pump.

3. The hydraulic system according to claim 1, wherein the first rate is faster than the second rate.

4. The hydraulic system according to claim 1, wherein the hydraulic pump upstrokes to maximum displacement and destrokes to a displacement less than maximum displacement.

5. The hydraulic system according to claim 4, wherein the displacement less than maximum displacement is zero displacement.

6. The hydraulic system according to claim 4, wherein the hydraulic pump cycles between the first displacement and the second displacement at a frequency such that the control module commands the hydraulic pump to maximum displacement before the hydraulic pump destrokes to the displacement less than maximum displacement

7. The hydraulic system according to claim 1, wherein the signal indicative of a desire to shake the implement includes a signal from the operator to move the implement in a first direction and to move the implement in a second direction and back to the first direction within a predetermined period of time.

8. A method of shaking an implement comprising the steps of:

receiving a signal indicative of a desire to shake the implement;

commanding a hydraulic pump to upstroke at a first rate; and commanding the hydraulic pump to destroke at a second rate, wherein, upon receiving the signal, the step of commanding to upstroke and the step of commanding to destroke occurs cyclically.

9. The method of shaking an implement according to claim 8, further comprising the step of upstroking the hydraulic pump to a first predetermined displacement before the hydraulic pump reaches a second predetermined displacement.

10. The method of shaking an implement according to claim 8, wherein the first predetermined displacement is maximum displacement.

11. The method of shaking an implement according to claim 10, wherein the second predetermined displacement is less than maximum displacement.

12. A method of shaking an implement, comprising the steps of:

receiving a signal indicative of a desire to shake the implement; and upstroking a hydraulic pump at a first rate and destroking the hydraulic pump at a second rate, wherein the upstroking and destroking cyclically occurs at a predetermined frequency such that the hydraulic pump is commanded to upstroke before the hydraulic pump fully destrokes.

13. The method according to claim 12, wherein the hydraulic pump is commanded to a first displacement at the first flow rate and to a second displacement at the second rate.

14. The method according to claim 13, wherein the first displacement is maximum displacement and the second displacement is a displacement less than maximum displacement.

15. The method according to claim 12, wherein the signal indicative of a desire to shake the implement is an input from an operator.

16. The method according to claim 15, wherein the operator indicates a desire to shake the implement by cyclically moving a joystick between two maximum positions.

17. The method according to claim 16, wherein the two maximum positions are a full forward position and a full backward position or a full left position and a full right position.

18. The method according to claim 15, wherein the operator indicates a desire to shake the implement by pressing a button on the joystick.

* * * * *